US009364026B2

(12) United States Patent
Liu

(10) Patent No.: US 9,364,026 B2
(45) Date of Patent: Jun. 14, 2016

(54) ELECTRONIC CIGARETTE TIGHTLY ENGAGED BY EXPANSION

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 500 days.

(21) Appl. No.: 13/992,739

(22) PCT Filed: Jan. 16, 2013

(86) PCT No.: PCT/CN2013/070513
§ 371 (c)(1),
(2) Date: Jun. 8, 2013

(87) PCT Pub. No.: WO2014/110723
PCT Pub. Date: Jul. 24, 2014

(65) Prior Publication Data

US 2014/0196734 A1 Jul. 17, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 8,863,753 | B2 * | 10/2014 | Li | A24F 47/008 131/270 |
| 9,032,968 | B2 * | 5/2015 | Glasberg | A24F 47/008 131/273 |
| 2011/0303231 | A1 * | 12/2011 | Li | A24F 47/008 131/329 |
| 2012/0174935 | A1 * | 7/2012 | Steinberg | A24F 1/32 131/329 |
| 2013/0192615 | A1 * | 8/2013 | Tucker | H01C 17/00 131/328 |

* cited by examiner

*Primary Examiner* — Michael H Wilson
*Assistant Examiner* — Eric Yaary
(74) *Attorney, Agent, or Firm* — Cheng-Ju Chiang

(57) ABSTRACT

The present invention is related to an electronic cigarette tightly engaged by expansion, which includes a sucking rod and a power rod, the sucking rod is configured with a first connector, the first connector includes a first seat and a first pole which are respectively served as two connecting electrodes of the first connector, and the first seat is configured with a first expanding portion; the power rod is configured with a second connector, the second connector comprises a second seat and a second pole which are respectively served as two connecting electrodes of the second connector, the second seat is configured with a second expanding portion tightly engaged with the first expanding portion by expansion; the first and second expanding portions are mutually tightly engaged by expansion to make the first connector to abut against the second connector and make the first pole to abut against the second pole.

12 Claims, 8 Drawing Sheets

ELECTRONIC CIGARETTE TIGHTLY ENGAGED BY EXPANSION

CROSS REFERENCE TO RELATED APPLICATIONS

The present application is a 35 U.S.C. §371 National Phase conversion of International (PCT) Patent Application No. PCT/CN2013/070513, filed on Jan. 16, 2013, the disclosure of which is incorporated by reference herein. The PCT International Patent Application was filed in Chinese.

TECHNICAL FIELD

This invention relates to a field of electronic cigarettes, and particularly to an electronic cigarette connected together by insertion and mutually tightly expanding engagement.

DESCRIPTION OF BACKGROUND

Current electronic cigarettes each comprise a sucking rod and a power rod, the sucking rod is configured with a first connector having outer threads at its end mated with the power rod, while the power rod is correspondingly configured with a second connector having inner threads to engage with the first connector, and the sucking rod and the power rod are threadedly connected together by means of the first connector and the second connector, installation by tightening the threads and detachment by loosening the threads are inconvenient; in addition, there is a risk of unreliable circuit connection between the first and second connectors.

SUMMARY

An object of the present invention is to provide an electronic cigarette tightly engaged by expansion, which is convenient and quick to be installed and detached and has reliable circuit connection.

To achieve the above object, the present invention provides an electronic cigarette tightly engaged by expansion, which comprises a sucking rod and a power rod, the sucking rod is configured with a first connector at its end mated with the power rod, the first connector comprises a first seat and a first pole which are respectively served as two connecting electrodes of the first connector, and the first seat is configured with a first expanding portion; the power rod is configured with a second connector at its end mated with the sucking rod, the second connector comprises a second seat and a second pole which are respectively served as two connecting electrodes of the second connector, the second seat is configured with a second expanding portion which is capable of being tightly engaged with the first expanding portion by expansion; the first expanding portion and the second expanding portion are mutually tightly engaged with each other by expansion to make the first connector to abut against the second connector and make the first pole to abut against the second pole.

Wherein, the first connector further comprises a first insulating sleeve for insulating the first seat and the first pole, the first seat is cylinder-shaped, and the first pole is inserted into a central portion of the first seat by means of the first insulating sleeve; the second connector further comprises a second insulating sleeve for insulating the second seat and the second pole, the second seat is cylinder-shaped, and the second pole is inserted into a central portion of the second seat by means of the second insulating sleeve.

Wherein, the first seat comprises a cylindrical upper part and a cylindrical lower part, the upper part is adapted for connecting and engaging with the end of the sucking cylinder, the lower part is adapted for connecting and engaging with the second seat; the second seat defines a through hole therein for insertion of the lower part of the first seat.

Wherein, the first expanding portion is a thimble sleeved around an outer wall of the lower part and made of plastic material, the thimble is cylindrical and configured with raised rings on its outer wall, and the second expanding portion is a sidewall of the through hole, the lower part is inserted into the through hole to firmly connect the first seat and the second seat by means of the raised rings of the thimble which are tightly engaged with the sidewall of the through hole by expansion.

Wherein, the thimble is made of any one of the following plastic materials, the silicone materials or rubber materials: ABS, PC, PE, POM, PP, PE, PVC, TPU, TPR, TPE or TPV.

Wherein, the lower part of the first seat is configured with an annular slot in its outer wall for accommodating the thimble.

Wherein, a positioning flange is radially outwardly extended between the upper part and the lower part for abutting against the end of the sucking rod, the positioning flange is simultaneously adapted for abutting against an end portion of the second seat to restrain its position; the lower part is configured with a locking ring on its inner wall for mounting the first pole, the first pole is positioned in the locking ring by means of the first insulating sleeve, the first pole defines a vent extended through its central portion; the second seat has its shape mated with the inner wall of the end of the power rod, and is tightly engaged with an inner wall of the end of the power rod by expanding its outer wall; the second seat is configured with a positioning flange radially outwardly extended from a sidewall of its extremity for mating with the end of the power rod.

Wherein, the first expanding portion is an outer wall of the lower part, the second expanding portion is a thimble embedded in an inner wall of the through hole and made of plastic material, and is cylindrical and configured with raised rings on its inner wall, the lower part is inserted into the through hole and further inserted into the thimble to firmly connect the first seat and the second seat by means of the raised rings which are firmly engaged with a sidewall of the lower part by expansion.

Wherein, the through hole of the second seat is axially extended, and an inner wall of the through hole is configured with an annular slot for accommodating the thimble.

Wherein, the second pole is inserted into the second insulating sleeve, the second insulating sleeve is positioned in an insulating sleeve pedestal and inserted in a central portion of the second seat by means of the insulating sleeve pedestal, the second pole is configured with a blocking ring at a portion thereof located in the insulating sleeve pedestal, and the second pole is sleeved by a spring at its the end adjacent the inside of the insulating sleeve pedestal, the spring has its opposite ends to respectively abut against the blocking ring and an inner end portion of the insulating sleeve pedestal to keep the second pole in a stretching state; the second pole has its end to stretch out of a bottom wall of the second insulating sleeve and has its another end to stretch out of a bottom wall of the insulating sleeve pedestal, the second pole defines a vent extended through its central portion.

Wherein, the insulating sleeve pedestal is cup-shaped, and comprises a sidewall, a bottom wall and a flange axially outwardly extended from the bottom wall, the bottom wall and the side wall encircle a first inner chamber for accommodating the second pole, the bottom wall is further configured with a first pole hole for the second pole to stretch out.

Wherein, the second insulating sleeve is cup-shaped, and comprises a sidewall and a bottom wall, the sidewall and the bottom wall encircle a second inner chamber for accommodating the second pole.

Wherein, the second insulating sleeve further comprises a positioning flange radially outwardly extended from the bottom wall, the bottom wall of the second insulating sleeve is further configured with a second pole hole axially extended through and communicated with the second inner chamber; the second insulating sleeve is tightly engaged with an inner wall of the first inner chamber of the insulating sleeve pedestal by expanding its sidewall and axially positioned by means of abutment of the positioning flange against an open end of the first inner chamber of the insulating sleeve pedestal.

Wherein, the second seat is further configured with a conducting component therein for getting good electrical contact between the first seat and the second seat, the conducting component is an annular elastic metal sheet defining an avoidance at its central portion, and the second pole passes through the avoidance of the conducting component and is kept away from an inner wall of the avoidance.

Wherein, the second seat is further configured with an annular positioning step on its inner wall, and the insulating sleeve pedestal combined with the second insulating sleeve is inserted into the second seat to make the conducting component to abut against the positioning step.

Adopted the above technical solutions, the electronic cigarette tightly engaged by expanding in the present invention has the following advantages: firstly, the sucking rod is configured with a first pole assembly assembled together in the first connector, the power rod is configured with a second pole assembly assembled together in the second connector, the first connector and the second connector as a whole make the electronic cigarette in the overall assembly and disassembly with less components, and the first connector and the second connector are tightly engaged by expansion through the first expanding portion and the second expanding portion, to make the electronic cigarette to be conveniently and quickly assembled and disassembled. Secondly, the lower part of the first seat is inserted into the through hole of the second seat and elastically abuts against and get good contact with the conducting component to conduct the first seat and the second seat, and to make the first pole and the second pole in good contact to be conducted, so as to ensure that the circuits are conducted and the sucking rod and the power rod are mutually tightly engaged by expansion, to get reliable circuit connection.

The embodiments of the present invention are further described in detail as follows in conjunction with the accompanying drawings.

DETAILED DESCRIPTION OF THE EMBODIMENTS

It should be noted that, the embodiments and the characteristics in the embodiments can be mutually combined in case of no confliction. The present invention would be further described in detail as follows in conjunction with the accompanying drawings and the specific embodiments.

Figure 1:
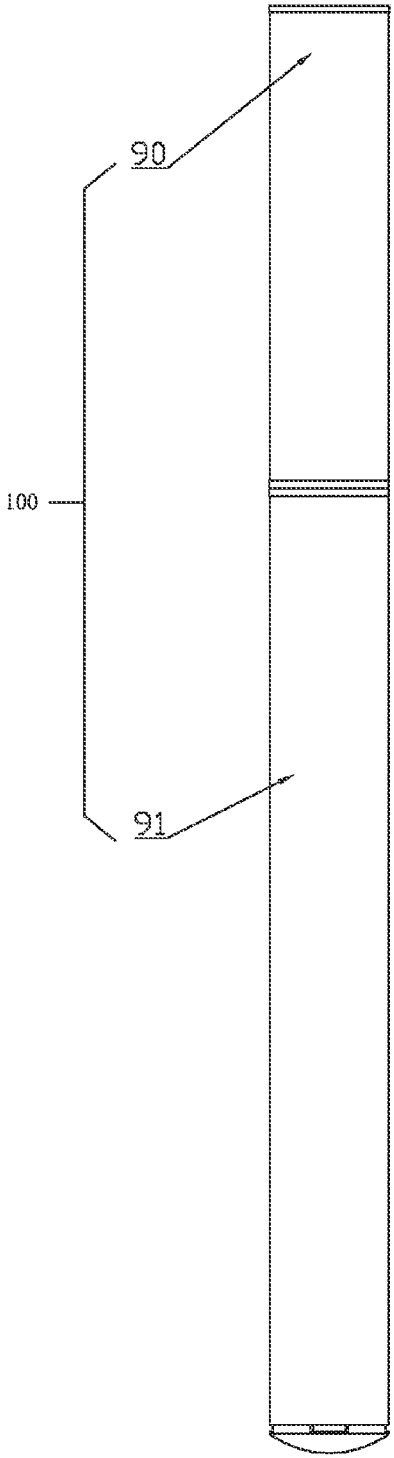
FIG. 1 is a main view of an electronic cigarette in accordance with a first embodiment of the present invention.

As shown from FIG. 1 to FIG. 9, a first embodiment of the present invention provides an electronic cigarette 100, the electronic cigarette 100 comprises a sucking rod 90 and a power rod 91, the sucking rod 90 and the power rod 91 are mutually connected together by insertion and tightly expending engagement. The sucking rod 90 is configured with a first connector 5 at its end mated with the power rod 91, the first connector 5 is configured with a first expanding portion, and the power rod 91 is configured with a second connector at its end mated with the sucking rod 90, the second connector 6 is configured with a second expanding portion which is capable of being tightly engaged with the first expanding portion by expansion; the first expanding portion and the second expanding portion are mutually tightly engaged with each other by expansion to make the first connector 5 to abut against the second connector 6, and the orientation as shown in FIG. 1 is referenced hereafter in the present embodiment.

Figure 2:
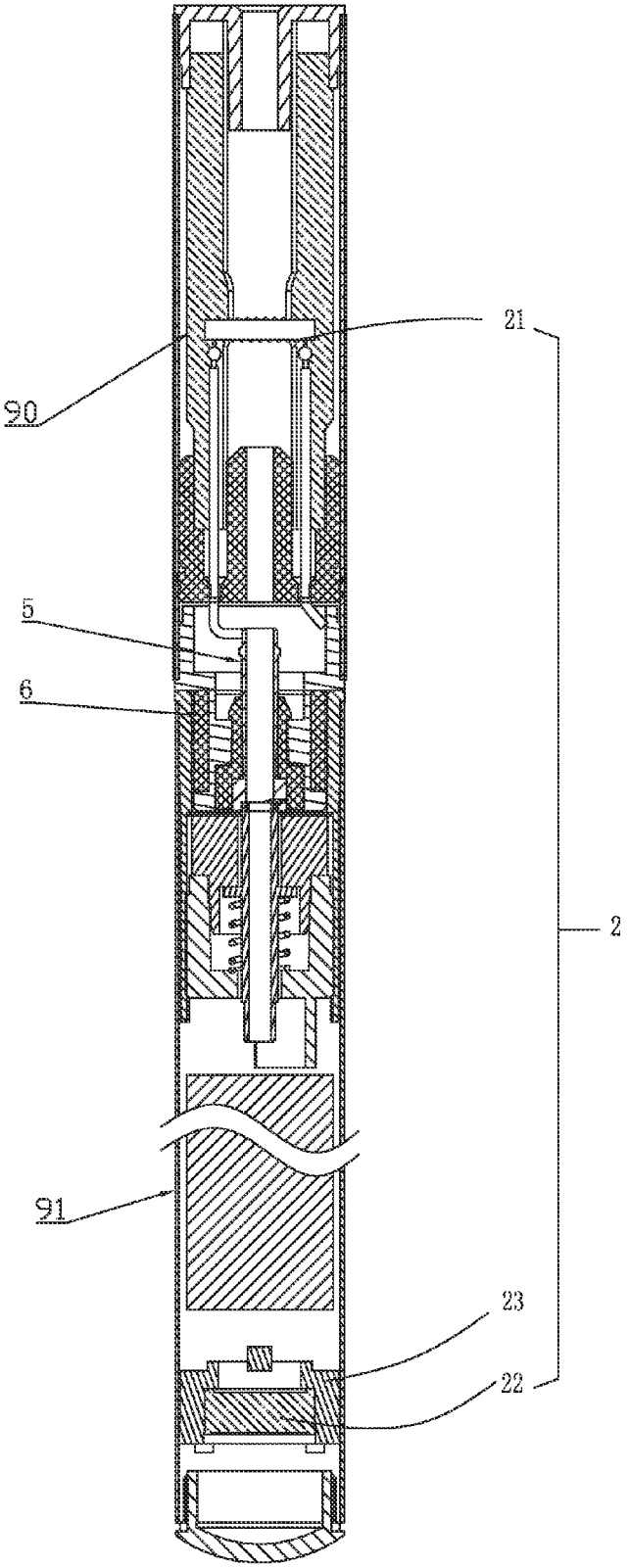
FIG. 2 is a cross-sectional view of the electronic cigarette in accordance with the first embodiment of the present invention.
Figure 3:
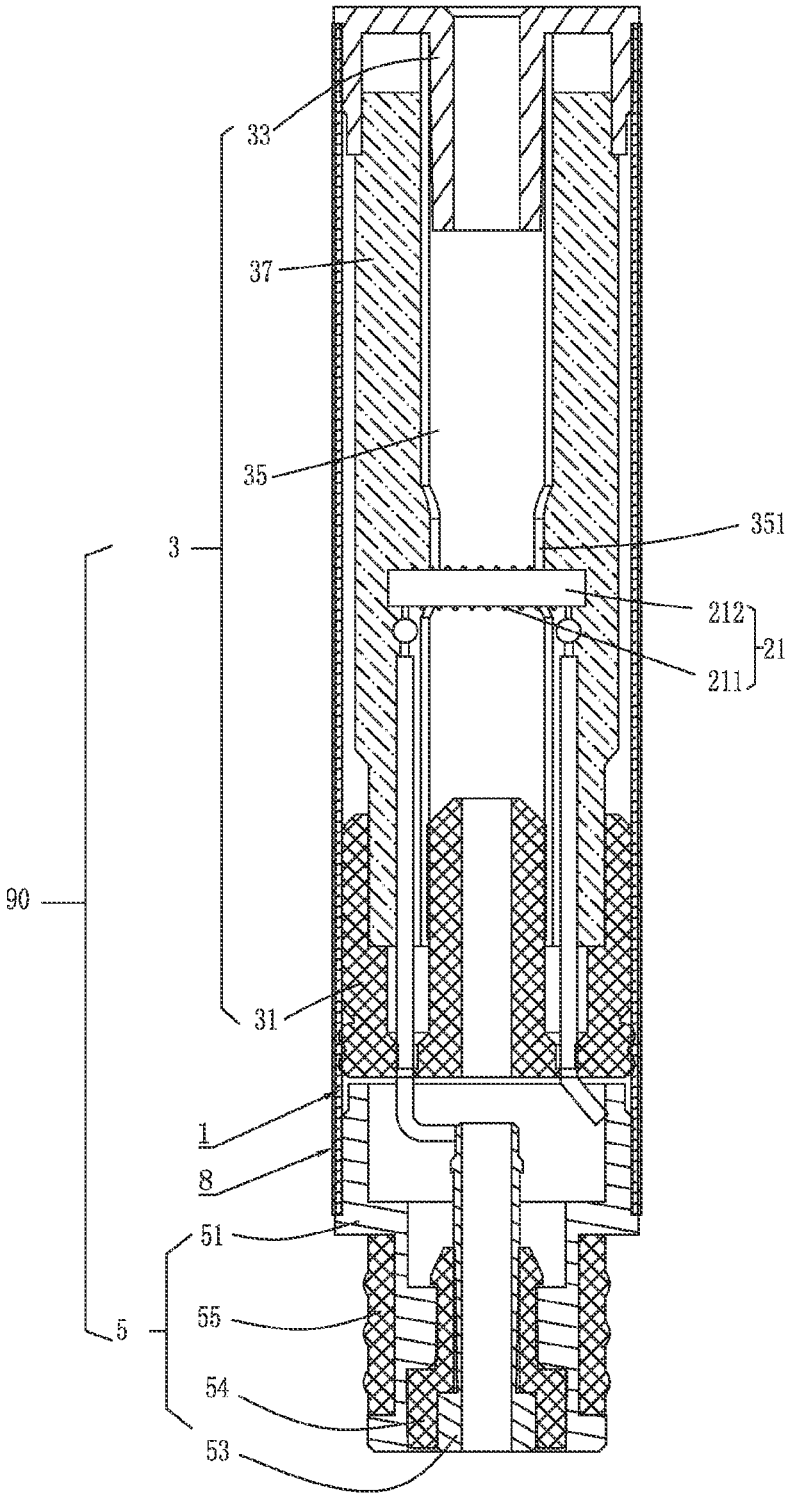
FIG. 3 is a cross-sectional view of a sucking rod of the electronic cigarette in accordance with the first embodiment of the present invention.

As shown in FIG. 2 and FIG. 3, in this embodiment, the sucking rod 90 of the electronic cigarette comprises a hollow cylinder-shaped sucking cylinder 1, an atomizing device 2, a liquid smoke cup 3, a nozzle 33 and the first connector 5 for connecting with the power rod 91. The nozzle 33 and the first connector 5 are respectively mounted at opposite ends of the sucking cylinder 1, the atomizing device 2 and the liquid smoke cup 3 are located within the sucking cylinder 1. The sucking cylinder 1 is further configured with a label layer 8 on its outer wall for adhering trademark or advertisement.

The first connector 5 comprises a first seat 51, a first pole 53 and a first insulating sleeve 54, and the first pole 53 defines a vent in its central portion. The first pole 53 is sleeved and positioned within the first insulating sleeve 54, the first pole 53 is inserted into a central portion of the first seat 51 by means of the first insulating sleeve 54, and the first pole 53 and the first insulating sleeve constitute a first pole component. In this embodiment, the first seat 51 and the first pole 53 are respectively served as two connecting electrodes of the first connector 5.

Figure 6:
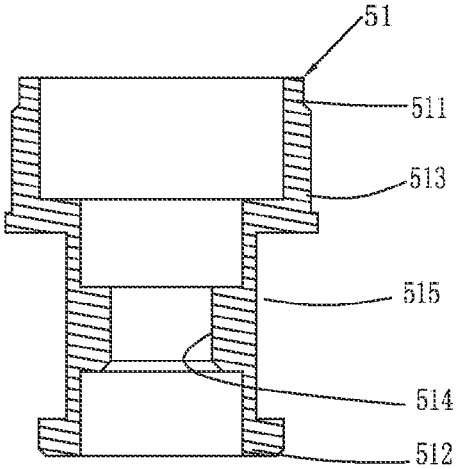
FIG. 6 is a cross-sectional view of a first seat of the electronic cigarette in accordance with the first embodiment of the present invention.
Figure 7:
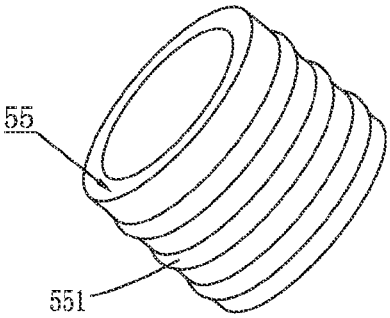
FIG. 7 is an isometric view of a thimble of the electronic cigarette in accordance with the first embodiment of the present invention.

As shown in FIG. 3 and FIG. 6, the first seat 51 is located at a second end of the sucking cylinder 1, and has its shape mated with the sucking cylinder 1, and can be made of conductive materials, and is inserted into the sucking cylinder 1. The first seat 51 is a substantially hollow cylinder, and comprises a cylindrical upper part 511 and a cylindrical lower part 512, the upper part 511 is used for connecting and engaging with the sucking cylinder 1, the lower part 512 is used for connecting and engaging with the power rod 91; a positioning flange 513 is configured at a circumference between the upper part 511 and the lower part 512, the positioning flange 513 is simultaneously used for abutting against the power rod 91 to restrain its position; the lower part 512 is configured with a locking ring 514 on its inner wall for mounting the first pole, the lower part 512 is further configured with an annular slot 515 inwardly dented from its outer wall.

The atomizing device 2 comprises an atomizer 21, an atomizer control circuit board 22 and a circuit board holder 23 for accommodating and positioning the atomizer control circuit board 22, in this embodiment, the atomizer 21 is configured within the sucking cylinder 1, while the atomizer control circuit board 22 and the circuit board holder 23 are configured within the power rod 91, and the atomizer control circuit board 22 is configured with a miniature pneumatic switch thereon to control the circuit to be conducted so that the atomizer 21 starts to work.

As shown in FIG. 3, the atomizer 21 is used for transforming the liquid smoke into smog, and comprises a heating wire 211 and a liquid guiding member 212 for absorbing the liquid smoke and supporting the heating wire 211, the heating wire 211 is wound around the liquid guiding member 212, the liquid guiding member 212 is capable of absorbing and reserving the liquid smoke, and is capable of being made of fiberglass or a material having liquid-absorbent and liquid storage properties such as cotton material. In the embodiment, the liquid guiding component 212 is accommodated and positioned within the liquid smoke cup 3, opposite ends of the heating wire 211 traverses through the liquid smoke cup 3 and then are electrically connected with positive and negative electrodes of the power rod 91.

As shown in FIG. 3, in this embodiment, the liquid smoke cup 3 comprises a cup holder 31, the nozzle 33, a conduit 35 and a liquid storage component 37. Wherein, the cup holder 31 and the nozzle 33 are opposed to each other and positioned within the inner wall of the sucking cylinder 1 with a predetermined distance; the conduit 35 is positioned between the cup holder 31 and the nozzle 33; the liquid storage component 37 is sleeved around and supported by the conduit 35 and disposed between the cup holder 31 and the nozzle 33.

As shown in FIG. 3, in this embodiment, the cup holder 31 is a cylindrical cup, and comprises an annular sidewall, a round cup bottom and a positioning post coaxially extended from the cup bottom. Wherein an annular inner chamber is defined between the annular sidewall and the positioning post; a vent hole is axially extended through the positioning post and the cup bottom; and two perforations (not shown) for the heating wire 211 to pass through are extended through the cup bottom. The sidewall is configured with an expanding ring for tightly engaging with the sucking cylinder 1 by expansion, the cup holder 31 is tightly engaged with the inner wall of the sucking cylinder 1 by expansion through its sidewall and the expanding ring.

The nozzle 33 is capable of being made of silicon material, and has its shape and size mated with the inner wall of the sucking cylinder 1. In this embodiment, it is a cylindrical cover, and comprises an annular sidewall, a top wall, and a positioning post coaxially extended from the top wall, and an annular inner chamber is defined by the positioning post and the sidewall. The nozzle 33 further comprises a nozzle hole axially extended through the positioning post and the top wall, and a positioning step radially outwardly extended to mate with a first end of the sucking cylinder 1. The nozzle 33 has its outer diameter slightly larger than an inner diameter of the sucking cylinder 1, and the nozzle 33 is tightly positioned to the inner wall of the sucking cylinder 1 by expansion through its sidewall. When the liquid smoke in the liquid smoke cup 3 is used out, taking out of the nozzle allows adding additional liquid smoke into the liquid smoke cup 3. The positioning post of the nozzle 33 and the positioning post of the cup holder are opposed to each other, and respectively fix opposite ends of the conduit 35. The annular inner chamber of the nozzle 33 and the annular inner chamber of the cup holder 31 are opposed to each other, and respectively accommodate opposite ends of the liquid storage component 37.

The conduit 35 (see FIG. 3) is used for supporting the liquid storage component 37, and simultaneously for determining the height of the liquid smoke cup 3 and supporting the liquid guiding member 212, and further works as a channel for guiding the smog generated by atomizing the liquid smoke through the atomizer 2 to an exterior of the sucking cylinder 1. In this embodiment, the conduit 35 is a hollow round tube having a central through hole, and is capable of being made of plastic or fiber material, such as fiberglass, and comprises a top portion and a bottom portion, and the top portion is sleeved around and circumferentially hermetical with the positioning post of the nozzle 33, and the bottom portion is sleeved around and circumferentially hermetical with the positioning post of the cup holder 31. The conduit 35 defines locking slots 351 extended through its wall, for supporting and positioning the liquid guiding member 212, the liquid guiding member 212 traverses through the conduit 35 and passes through the locking slots 351 and further abuts against the liquid storage component 37 for absorbing the liquid smoke for the heating wire 211 to atomize.

The liquid storage component 37 is used for absorbing and reserving the liquid smoke injected into the liquid smoke cup 3 for the atomizer 2 to subsequent atomization, which is capable of absorbing and reserving the liquid smoke, and can be made of materials having liquid-absorbent and liquid storage properties such as cotton material. The liquid storage component 37 has a hollow cylindrical structure, and is sleeved around the conduit 35 and mutually tightly engaged with an outer wall of the conduit by expansion to thereby be supported, and has its opposite ends inserted into the annular inner chamber of the cup holder 31 and the annular inner chamber of the nozzle 33. Outer wall of the liquid storage component 37 abuts against the liquid guiding member, and the liquid smoke is infiltrated from the liquid storage component 37 into the liquid guiding member 212 and atomized by the heating wire 211 to become smog.

Figure 4:
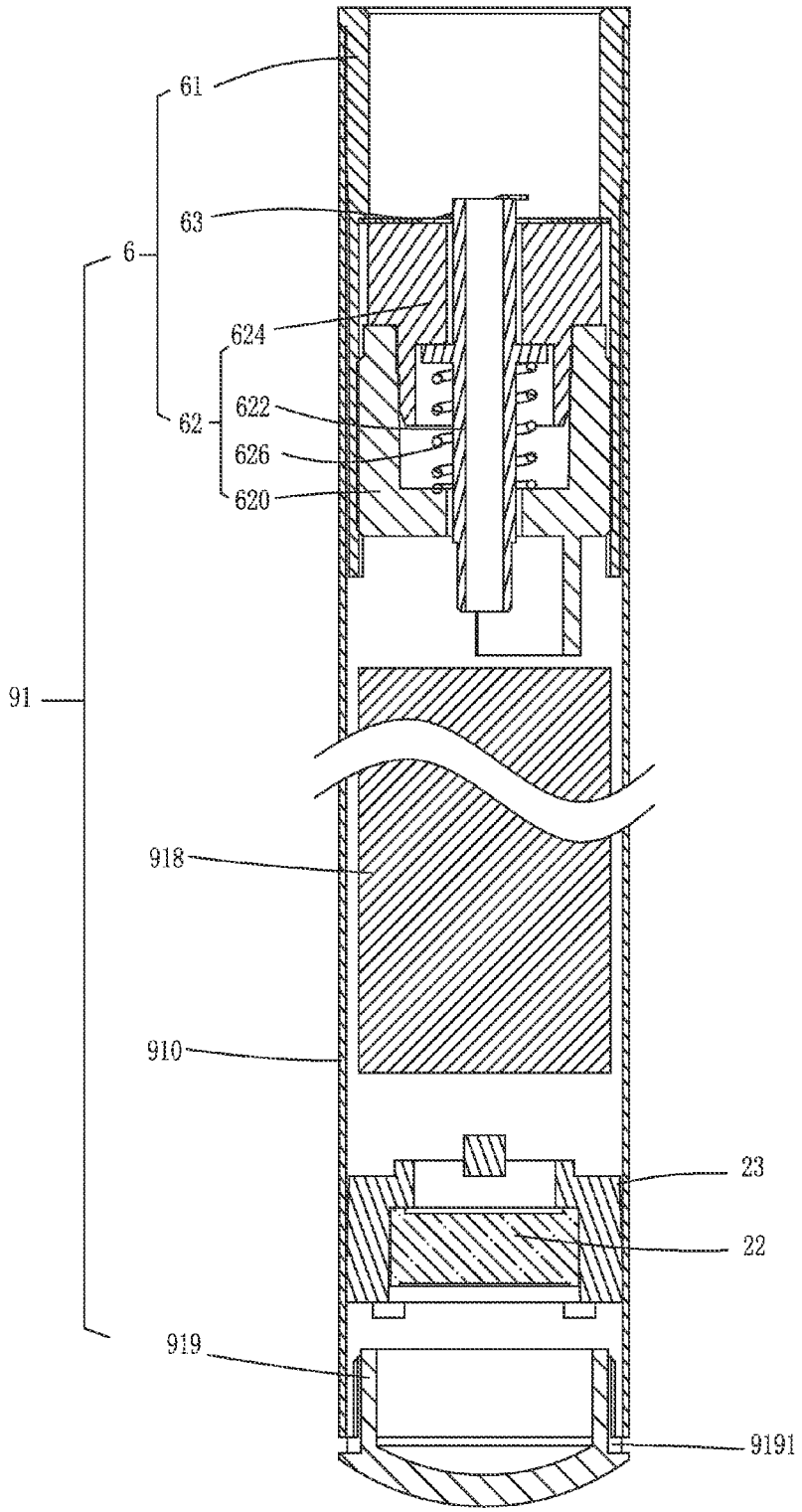
FIG. 4 is a cross-sectional view of a power rod of the electronic cigarette in accordance with the first embodiment of the present invention.

As shown in FIG. 2 and FIG. 4, the power rod 91 is entirely cylindrical, and comprises a sheath 910, a second connector 6 configured at an end of the sheath 910 which is connected with the sucking rod 90 for connecting with the first connector 5, and a storage battery 918 in the sheath 910 etc. The power rod 91 has its another end to be configured with an end cover 919, and the end cover 919 defines an air intake 9191 therein.

Figure 5:
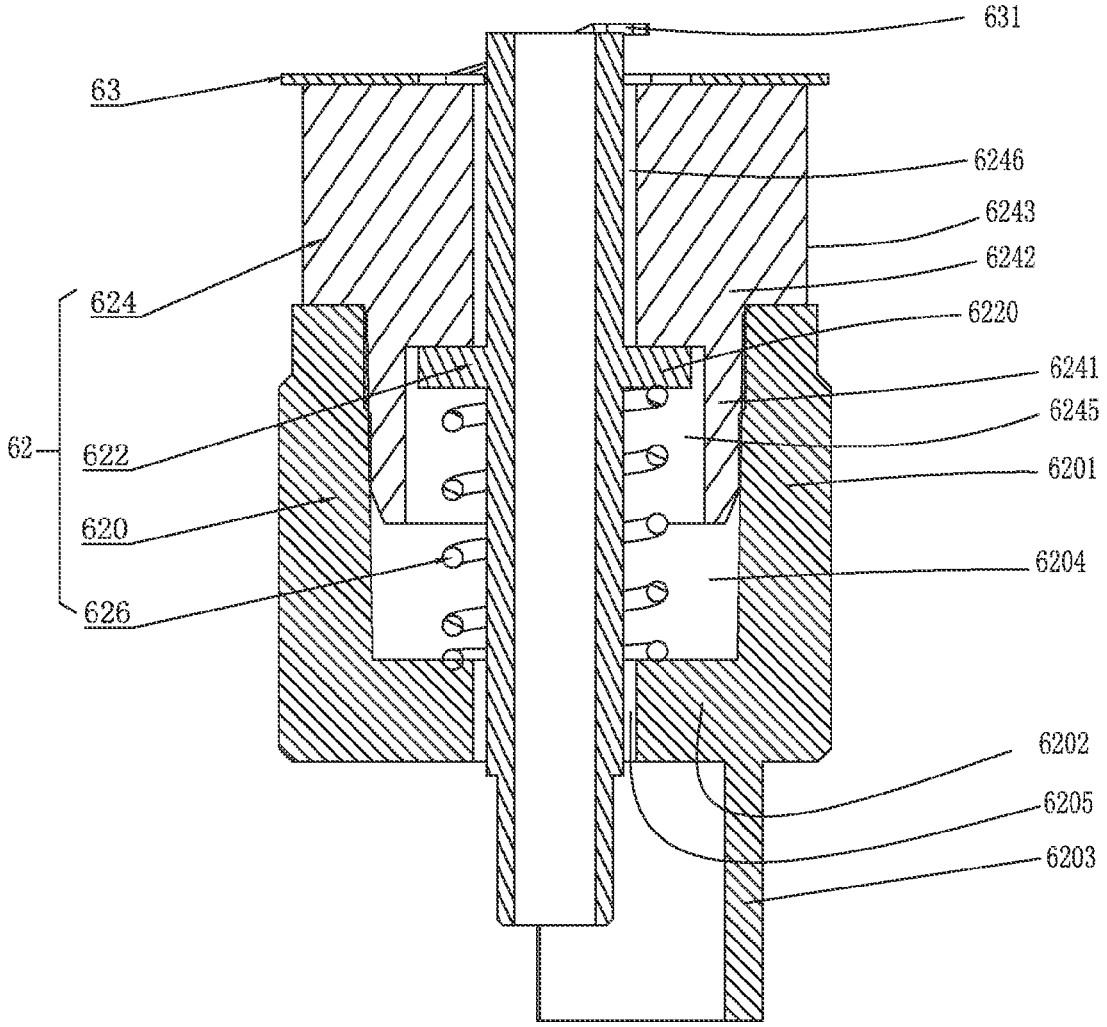
FIG. 5 is a cross-sectional view of a second pole assembly of the electronic cigarette in accordance with the first embodiment of the present invention.

As shown in FIG. 4 and FIG. 5, the second connector 6 comprises a second seat 61 and a second pole component 62 configured within the second seat 61.

Figure 8:
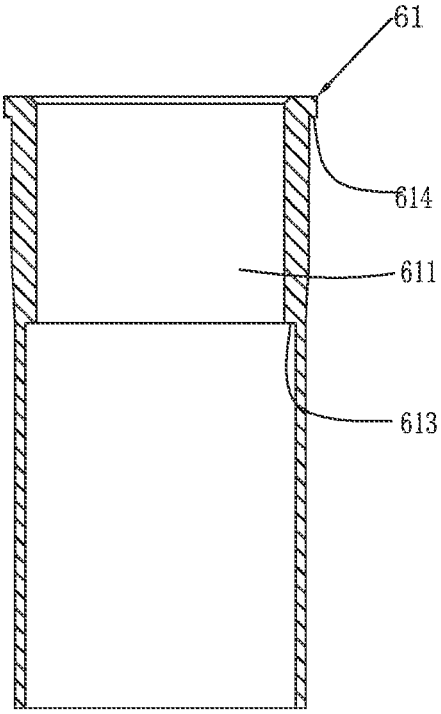
FIG. 8 is a cross-sectional view of a second seat of the electronic cigarette in accordance with the first embodiment of the present invention.

As shown in FIG. 8, the second seat 61 is a substantially hollow round cylinder, and defines a through hole 611 therein which is axially extended, and an inner wall of the through hole 611 is configured with a positioning step 613 to divide the second seat 61 into an upper portion having a smaller inner diameter and a lower portion having a larger inner diameter, the second pole component 62 is inserted into the lower portion of the second seat 61 and abuts against the positioning step 613; the upper portion is mated with the lower part 512 of the first seat 51, for facilitating an insertion of the first seat 51. The second seat 61 is configured with a positioning flange 614 radially outwardly extended from a sidewall of its extremity for mating with the sheath 910.

As shown from FIG. 4 to FIG. 5, the second pole component 62 comprises an insulating sleeve pedestal 620, a second pole 622 configured in the insulating sleeve pedestal 620, a spring 626 sleeved around the second pole 622 and a second insulating sleeve 624 configured between the insulating sleeve pedestal 620 and the second pole 622. The second pole 622 defines a vent extended through its central portion. The second pole component 62 is constituted by the insulating sleeve pedestal 620, the second pole 622, the second insulating sleeve 624 and the spring 626, as a whole after assembled together, to facilitate the assembly and detachment of the electronic cigarette, and make the assembly and detachment of the electronic cigarette quick and easy. In this embodiment, the second seat 61 and the second pole 622 are respectively served as two connecting electrodes of the second connector 6.

As shown in FIG. 5, the insulating sleeve pedestal 620 is substantially cup-shaped, and is made of insulation materials, and comprises a sidewall 6201, a bottom wall 6202 and a flange 6203 axially outwardly extended from the bottom wall 6202 for facilitating welding, and the sidewall 6201 and the bottom wall 6202 encircle a first inner chamber 6204 for accommodating the second pole 622, and the bottom wall 6202 is further configured with a first pole hole 6205 for the second pole 622 to stretch out. The second pole 622 is inserted into the second insulating sleeve 624, and has its one end to stretch out and abut against a corresponding pole of an external connector, the second pole 622 is further configured with a blocking ring 6220 at a portion thereof located in the insulating sleeve pedestal 620, and the second pole 622 is sleeved with the spring 626 at the portion thereof located in the insulating sleeve pedestal 620, and the spring 626 has its opposite ends to respectively abut against the blocking ring 6220 and the bottom wall of the insulating sleeve pedestal 620, and keeps the second pole 622 in a stretching state. The second insulating sleeve 624 is also substantially cup-shaped, and comprises a sidewall 6241, a bottom wall 6242 and a positioning flange 6243 radially outwardly extended from the bottom wall 6242, the sidewall 6241 and the bottom wall 6242 encircle a second inner chamber 6245 for accommodating the second pole 622, the bottom wall is further configured with a second pole hole 6246 coaxially extended therethrough and communicated with the second inner chamber 6245. The second insulating sleeve 624 is tightly engaged with an inner wall of the first inner chamber 6204 of the insulating sleeve pedestal 620 by expanding its sidewall and axially positioned by means of abutment of the positioning flange 6243 against an open end of the first inner chamber 6204 of the insulating sleeve pedestal 620. The second pole 622 has its one end to pass through the second pole hole 6246 and stretch out of the bottom wall 6242 of the second insulating sleeve 624, the blocking ring 6220 of the second pole 622 always abuts against the bottom wall 6242 of the second insulating sleeve 624 because of a biasing force of the spring 626, the second pole 622 has its another end to pass through the first pole hole 6205 and stretch out of the bottom wall 6202 of the insulating sleeve pedestal 620.

Figure 9:
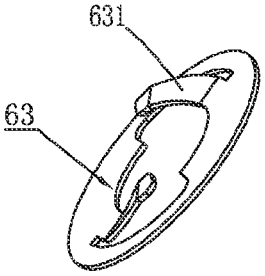
FIG. 9 is an isometric view of a conducting component of the electronic cigarette in accordance with the first embodiment of the present invention.
Figure 10:
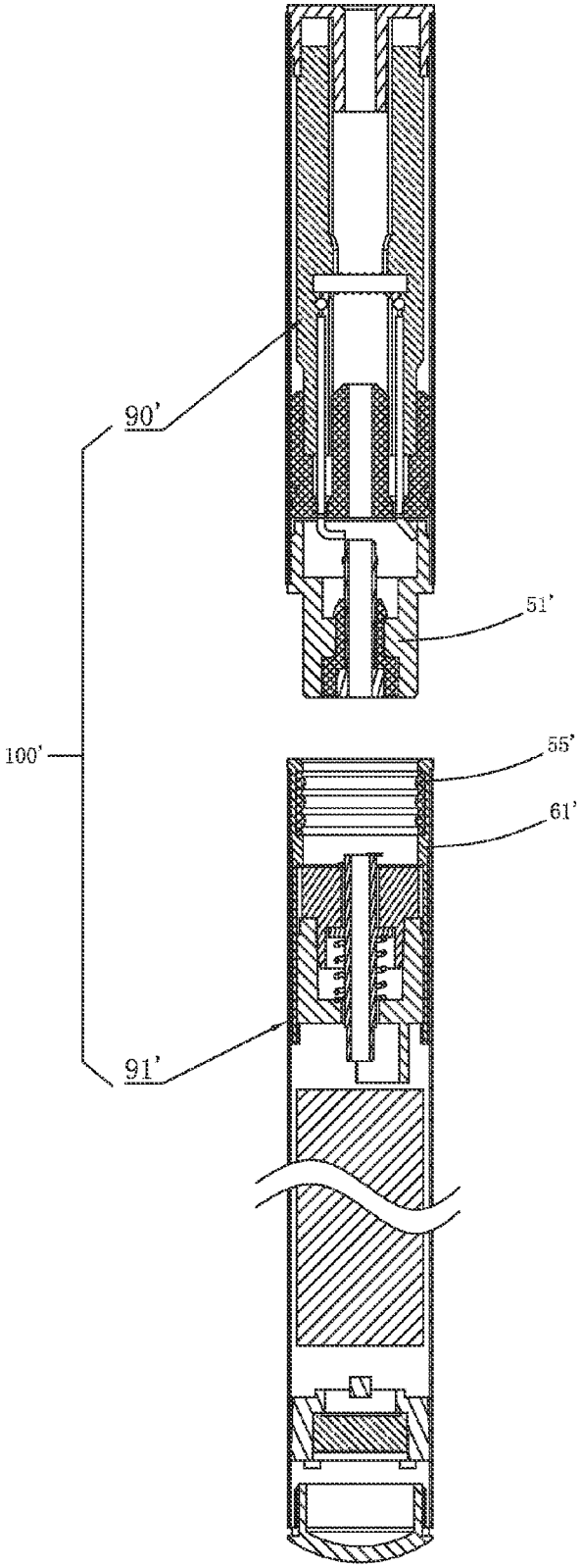
FIG. 10 is a cross-sectional view of an electronic cigarette in accordance with a second embodiment of the present invention.

To ensure good contact between the sucking rod and the power rod, the second seat 61 is further configured with a conducting component 63 (as shown in FIG. 9) therein for getting good electrical contact between the first seat 51 and the second seat 61, the conducting component 63 is an annular elastic metal sheet defining an avoidance at its central portion, and the second pole 622 passes through the avoidance of the conducting component 63 and is kept away from an inner wall of the avoidance to avoid short-circuit. The second pole component 62 is inserted into the second seat 61 to make the conducting component to abut against the positioning step 613 so that the conducting component 63 is in good electrical contact with the second seat 61. The conducting component 63 is further configured with elastic pins 631 axially outwardly protruded from a sidewall of the avoidance thereof, for elastically abutting against the first seat 51 to conduct the circuit.

The first seat 51 is configured with the first expanding portion, in this embodiment, the first expanding portion is a thimble 55 sleeved around the outer wall of the first seat 51 in the annular slot 515, and is cylindrical and configured with raised rings 551 on its outer wall, the second expanding portion is the sidewall of the through hole of the second seat 61, particularly is the sidewall of the through hole 611 at the upper portion, the lower part 512 is inserted into the through hole 611 to firmly connect the first seat 51 and the second seat 61 by means of the raised rings 551 of the thimble 55 which are tightly engaged with the sidewall of the through hole 611 by expansion. The thimble is made of any one of the following plastic materials, the silicone materials or rubber materials: ABS, PC, PE, POM, PP, PE, PVC, TPU, TPR, TPE or TPV. Soft plastic material having required hardness is preferred.

As shown in FIG. 2, after the first connector 5 of the sucking rod 90 is inserted into the second connector 6 of the power rod 91 in right place, the lower part 512 of the first seat 51 is inserted into the through hole 611 of the second seat 61, and further elastically abuts against and gets good contact with the elastic pins 631 of the conducting component 63 so that the first seat 51 and the second seat 61 are electrically conducted, while the second pole 622 of the second connector 6 is abutted against by an end portion of the first pole 53 of the first connector 5 to overcome the biasing force of the spring 626 and slightly retract and firmly abuts against the first pole 53 because of the spring 626, to ensure good contact of the first pole 53 and the second pole 622; this ensures good contact of the first connector 5 and the second connector 6, thereby to get corresponding communication between the circuits of the sucking rod 90 and the power rod 91.

In addition, as shown from FIG. 2 to FIG. 4, external air goes into the power rod 91 from the air intake 9191 of the end cover 919 located on the bottom of the power rod, enters the sucking rod 90 via the vent in the central portion of the second pole 622 and the vent in the central portion of the first pole 53, and then in turn passes by the vent hole of the cup holder 31 of the liquid smoke cup 3, the central through hole of the conduit 35 and the nozzle hole of the nozzle 33 and flows out of the sucking rod 90, to form an air channel inside the electronic cigarette and keep smooth air-exchange between the electronic cigarette and the exterior. Certainly, external air can also go into the sucking rod 90 directly through the nozzle hole of the nozzle 33 and then reach the conduit 35.

Figure 11:
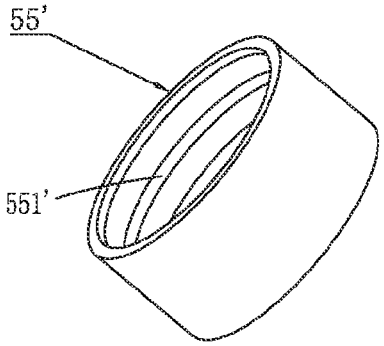
FIG. 11 is an isometric view of a thimble of the electronic cigarette in accordance with the second embodiment of the present invention.
Figure 12:
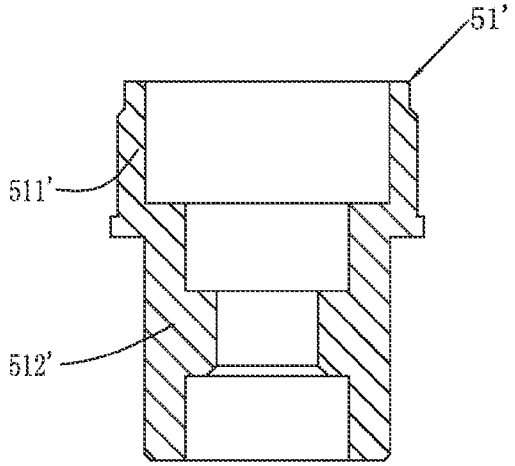
FIG. 12 is a cross-sectional view of a first seat of the electronic cigarette in accordance with the second embodiment of the present invention.
Figure 13:
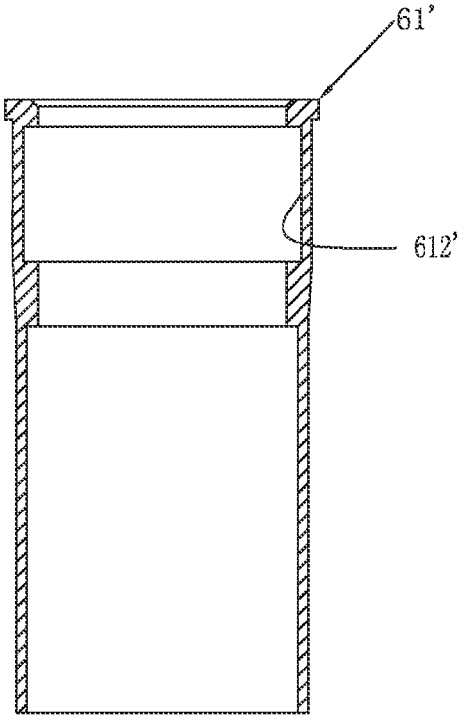
FIG. 13 is a cross-sectional view of a second seat of the electronic cigarette in accordance with the second embodiment of the present invention.

As shown from FIG. 10 to FIG. 13, a second embodiment of the present invention further provides an electronic cigarette 100', comprising a sucking rod 90 and a power rod 91 mutually connected together, which has a substantially similar structure to the electronic cigarette 100 of the first embodiment, but has its first expanding portion and second expanding portion configured in different location and manner with their related components correspondingly modified, and comprises a first seat 51' (as shown in FIG. 11), a cylindrical thimble 55 (as shown in FIG. 12) and a second seat 61' (as shown in FIG. 13). Simultaneously, the first seat 51' comprises a cylindrical upper part 511' and a cylindrical lower part 512', and the lower part 512' works as the first expanding portion. The second seat 61' is similar to the second seat 61, the second seat 61' is configured with an annular slot 612' at its inner wall for locking the thimble 55', and the thimble 55' is located in the second seat 61', and works as the second expanding portion, the thimble 55' is also configured with raised rings 551', the raised rings 551' are sleeved on an inner wall of the thimble 55'.

Changes and improvements can be made on the present invention based on the above embodiments, for example: the first connector 5 and the second connector 6 can be exchanged; correspondingly other related components should be adjusted.

The above-described is embodiments of the present invention, it should be noted that, for the persons of ordinary skill in this field, various changes and improvements within the principle and spirit of the present invention can be made, and the changed and improved solutions also fall into the protecting scope of the present invention.

What is claimed is:

1. An electronic cigarette tightly engaged by interference, comprises a sucking rod and a power rod, wherein the sucking rod is configured with a first connector at its end mated with the power rod, the first connector comprises a first seat and a first pole which are respectively served as two connecting electrodes of the first connector, and the first seat is configured with a first interference portion; the power rod is configured with a second connector at its end mated with the sucking rod, the second connector comprises a second seat and a second pole which are respectively served as two connecting electrodes of the second connector, the second seat is configured with a second interference portion which is capable of being tightly engaged with the first interference portion by interference; the first interference portion and the second interference portion are mutually tightly engaged with each other by interference to make the first connector to abut against the second connector and make the first pole to abut against the second pole;

the first connector further comprises a first insulating sleeve for insulating the first seat and the first pole, the first seat is cylinder-shaped, and the first pole is inserted into a central portion of the first seat by means of the first insulating sleeve; the second connector further comprises a second insulating sleeve for insulating the second seat and the second pole, the second seat is cylinder-shaped, and the second pole is inserted into a central portion of the second seat by means of the second insulating sleeve;

the second pole is inserted into the second insulating sleeve, the second insulating sleeve is positioned in an insulating sleeve pedestal and inserted in a central portion of the second seat by means of the insulating sleeve pedestal, the second pole is configured with a blocking ring at a portion thereof located in the insulating sleeve pedestal, and the second pole is sleeved by a spring at the portion thereof located in the insulating sleeve pedestal, the spring has its opposite ends to respectively abut against the blocking ring and an inner end portion of the insulating sleeve pedestal to keep the second pole in a stretching state; the second pole has its one end to stretch out of a bottom wall of the second insulating sleeve and has its another end to stretch out of a bottom wall of the insulating sleeve pedestal, the second pole defines a vent extended through its central portion.

2. The electronic cigarette as described in claim 1, wherein, the first seat comprises a cylindrical upper part and a cylindrical lower part, the upper part is adapted for connecting and engaging with the end of the sucking rod, the lower part is adapted for connecting and engaging with the second seat; the second seat defines a through hole therein for insertion of the lower part of the first seat.

3. The electronic cigarette as described in claim 2, wherein, the first interference portion is a thimble sleeved around an outer wall of the lower part and made of plastic material, the thimble is cylindrical and configured with raised rings on its outer wall, and the second interference portion is a sidewall of the through hole, the lower part is inserted into the through hole to firmly connect the first seat and the second seat by means of the raised rings of the thimble which are tightly engaged with the sidewall of the through hole by expansion.

4. The electronic cigarette as described in claim 3, wherein, the lower part of the first seat is configured with an annular slot in its outer wall for accommodating the thimble.

5. The electronic cigarette as described in claim 2, wherein, the first interference portion is an outer wall of the lower part, the second interference portion is a thimble embedded in an inner wall of the through hole and made of plastic material, and is cylindrical and configured with raised rings on its inner wall, the lower part is inserted into the through hole and further inserted into the thimble to firmly connect the first seat and the second seat by means of the raised rings which are firmly engaged with a sidewall of the lower part by interference.

6. The electronic cigarette as described in claim 5, wherein, the through hole of the second seat is axially extended, and an inner wall of the through hole is configured with an annular slot for accommodating the thimble.

7. The electronic cigarette as described in claim 2, wherein, a positioning flange is radially outwardly extended between the upper part and the lower part for abutting against the end of the sucking rod, the positioning flange is simultaneously adapted for abutting against an end portion of the second seat to restrain its position; the lower part is configured with a locking ring on its inner wall for mounting the first pole, the first pole is positioned in the locking ring by means of the first insulating sleeve, the first pole defines a vent extended through its central portion; the second seat has its shape mated with the inner wall of the end of the power rod, and is tightly engaged with an inner wall of the end of the power rod by interference; the second seat is configured with a positioning flange radially outwardly extended from a sidewall of its extremity for mating with the end of the power rod.

8. The electronic cigarette as described in claim 1, wherein, the insulating sleeve pedestal is cup-shaped, and comprises a sidewall, a bottom wall and a flange axially outwardly extended from the bottom wall, the bottom wall and the side wall encircle a first inner chamber for accommodating the second pole, the bottom wall is further configured with a first pole hole for the second pole to stretch out.

9. The electronic cigarette as described in claim 8, wherein, the second insulating sleeve is cup-shaped, and comprises a sidewall and a bottom wall, the sidewall and the bottom wall encircle a second inner chamber for accommodating the second pole.

10. The electronic cigarette as described in claim 9, wherein, the second insulating sleeve further comprises a positioning flange radially outwardly extended from the bottom wall, the bottom wall of the second insulating sleeve is further configured with a second pole hole axially extended through and communicated with the second inner chamber; the second insulating sleeve is tightly engaged with an inner wall of the first inner chamber of the insulating sleeve pedestal by interference and axially positioned by means of abutment of the positioning flange against an open end of the first inner chamber of the insulating sleeve pedestal.

11. The electronic cigarette as described in claim 1, wherein, the second seat is further configured with a conducting component therein for getting good electrical contact between the first seat and the second seat, the conducting component is an annular elastic metal sheet defining an avoidance at its central portion, and the second pole passes through the avoidance of the conducting component and is kept away from an inner wall of the avoidance.

12. The electronic cigarette as described in claim 11, wherein, the second seat is further configured with an annular positioning step on its inner wall, and the insulating sleeve pedestal combined with the second insulating sleeve is inserted into the second seat to make the conducting component to abut against the positioning step.

* * * * *